United States Patent [19]

McCreadie et al.

[11] Patent Number: 4,579,113

[45] Date of Patent: Apr. 1, 1986

[54] DISPOSABLE COVERS FOR RESPIRATORS

[75] Inventors: John B. McCreadie, Shawnee; James M. Cooper, Shawnee Mission, both of Kans.

[73] Assignee: Parmelee Industries, Inc., Kansas City, Mo.

[21] Appl. No.: 602,910

[22] Filed: Apr. 23, 1984

[51] Int. Cl.[4] ..... A62B 7/00

[52] U.S. Cl. ..... 128/202.13; 128/206.12; 128/206.17; 128/206.21; 2/46; 2/9

[58] Field of Search ..... 128/206.12, 206.15, 128/206.17, 206.19, 206.21, 206.28, 207.12, 909, 139, 206.24, 206.25, 206.27, 207.11, 201.23, 201.25, 201.28, 201.29; 2/46

[56] References Cited

U.S. PATENT DOCUMENTS

| | | | |
|---|---|---|---|
| 2,462,005 | 2/1949 | Schauweker | 128/207.11 |
| 2,529,106 | 11/1950 | Schauweker | 128/201.25 |
| 2,642,574 | 6/1953 | Eloranta | 128/201.28 |
| 2,744,525 | 5/1956 | Whipple | 128/206.15 |
| 2,810,385 | 10/1957 | Reed | 128/201.23 |
| 2,821,192 | 1/1958 | Monro | 128/201.25 |
| 2,827,900 | 3/1958 | Marietta | 128/206.28 |

FOREIGN PATENT DOCUMENTS

| | | | |
|---|---|---|---|
| 195481 | 4/1938 | Switzerland | 128/206.21 |

*Primary Examiner*—Henry J. Recla

*Attorney, Agent, or Firm*—Schmidt, Johnson, Hovey & Williams

[57] ABSTRACT

A disposable protective cover for face-engaging respirators, or the like, which is particularly useful in a contaminated environment in preventing particulate buildup on the respirator. For example, in painting operations the cover protects the respirator from paint buildup and contamination, preserving the respirator from undue wear and reducing frequent cleaning and maintenance of the respirator. The cover presents a thin, flexible body configured to generally conform to the shape of the outer surface of the respirator. The body has an opening to provide access to the respirator intake and a cuplike section to provide a loose fit of the cover around the respirator exhalation valve to allow unrestricted breathing. The covers hereof present structure for quick attachment or detachment of the covers from the respirator. The exact structural features of the covers are adapted to accommodate different types of respirators, such as full face or half-face masks, and external air source or filter type masks.

9 Claims, 15 Drawing Figures

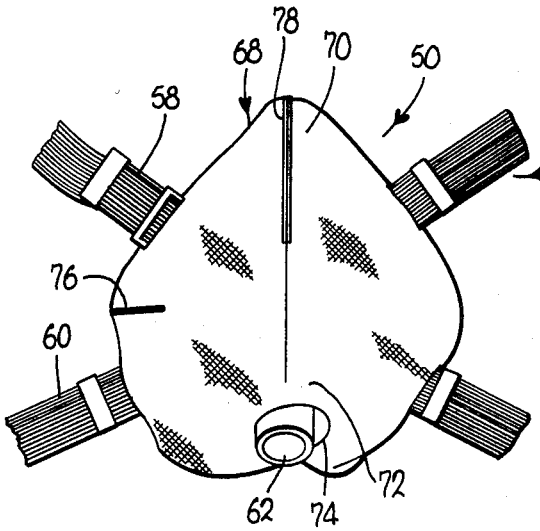
Fig. 6
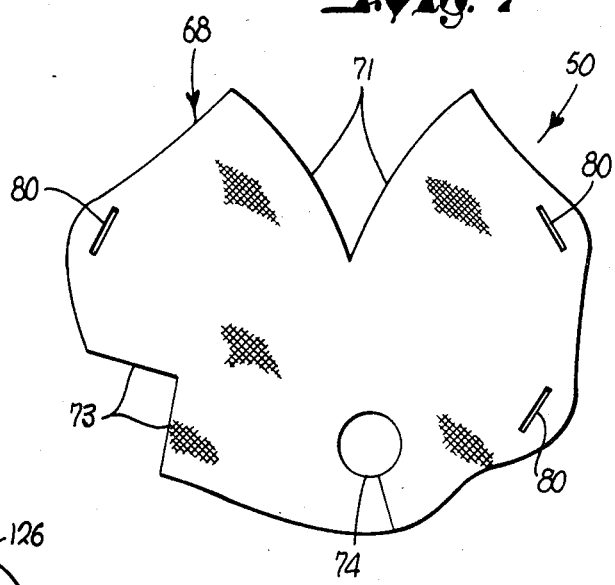
Fig. 7
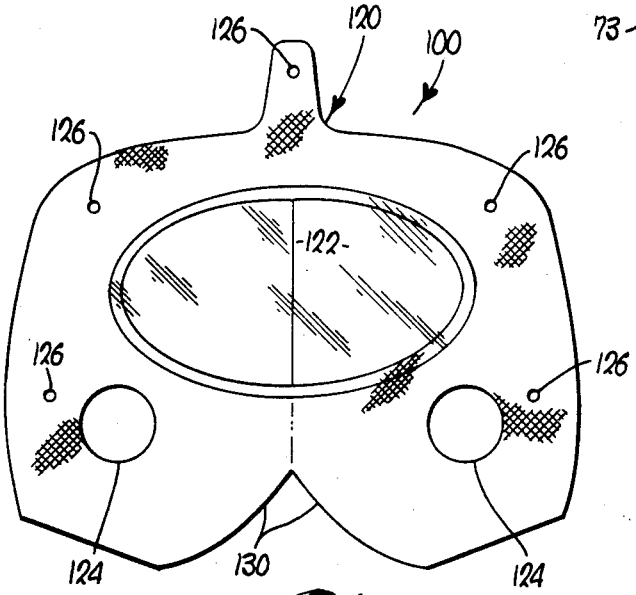
Fig. 10
Fig. 9
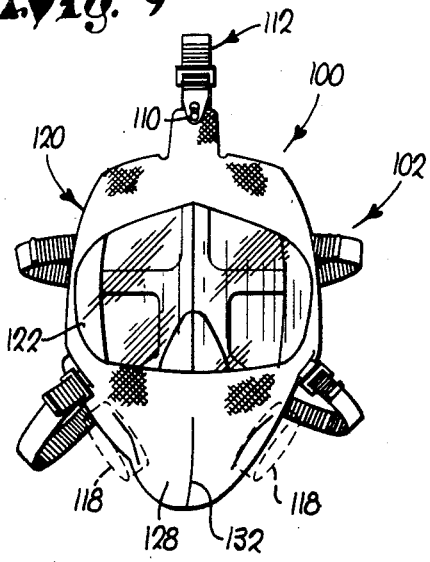

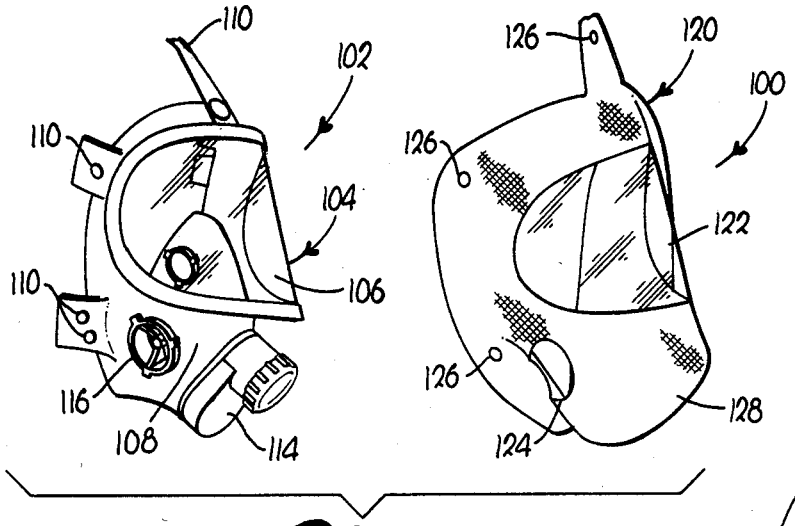
Fig. 8
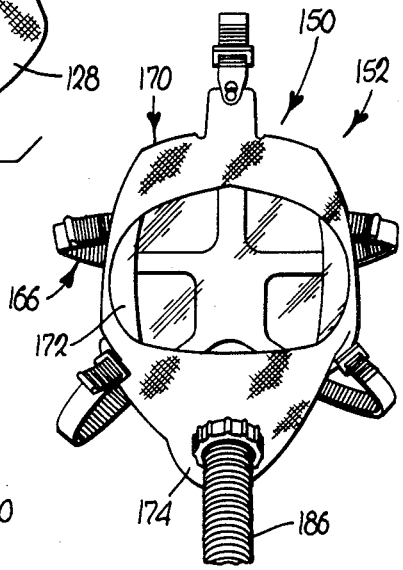
Fig. 12
Fig. 11
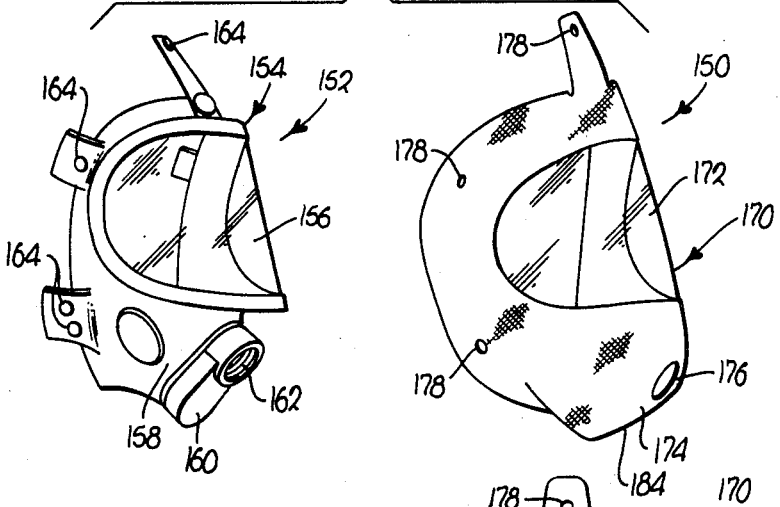
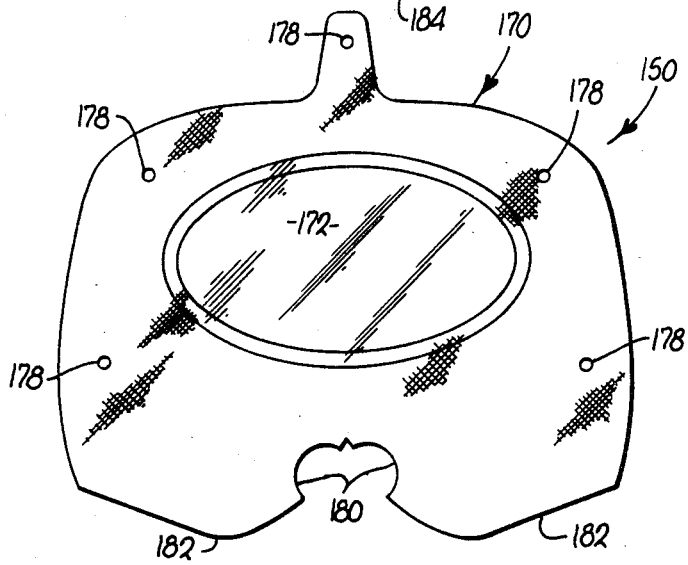
Fig. 13

DISPOSABLE COVERS FOR RESPIRATORS

BACKGROUND OF THE INVENTION

1. Field of the Invention

This invention relates to disposable covers for face masks, respirators, or the like, which are particularly useful in protecting the respirator in many types of environments without impairing the operation of the respirator.

2. Description of the Prior Art

In many different types of industrial environments, it is necessary for a worker to wear some type of respirator to avoid breathing contamination in the air of the work environment. To this end, different types of respirators have been devised for providing the worker with uncontaminated breathing air. For example, in a spray paint booth in which paint is sprayed, the worker might wear a half-mask respirator which sealingly conforms around the worker's face and mouth. Such a half-mask respirator would use either filters to allow the worker to breath air filtered from the environment, or the mask would be connected to a source of breathable air derived outside of the contaminated work environment.

In other toxic work environments, it is necessary to additionally protect the eyes of the worker. In such toxic environments, a full-face mask respirator is used which sealingly engages the worker's face along the periphery thereof, to not only supply breathable air to the worker, but also to protect the worker's eyes. Such a full-face mask can also be of the filter type or of the external air supply type.

Regardless of which type of respirator is used by the worker, in many of such work environments particles of the environment often adhere to the outer surface of the respirator and contaminate the respirator inhibiting effective mask operation. Further, contaminant particles, in addition to adhering to the outer surface of the respirator, often lodge in the area of the exhalation valve of the respirator causing inefficient operation. In such particle-ladened work environments, it is therefore necessary to frequently clean the respirator to provide effective operation.

While frequent cleaning of respirators is desirable, many airborne particulates adhere to the respirator and are difficult to remove. The extra time required for cleaning adds manpower costs to the operation. Further, such a contaminated build-up on the outside of the respirator surface deteriorates the useful life of the respirator. Therefore, it would be a significant advance in the art if in such contaminated work environments, the respirator could be protected from the harmful effects of the particles in the environment.

SUMMARY OF THE INVENTION

The disposable cover of the present invention substantially solves the problems associated with such contaminated work environments by protecting the respirators worn by the worker. That is, the cover hereof substantially conforms to the outer surface of the respirator, and protects the exhalation valve thereof from particulate accumulation. After a large amount of particle build-up on the cover, the cover is detached from the respirator and thrown away and a new cover installed substantially reducing respirator cleaning costs.

Generally speaking, face-engaging respirators (whether full-face, half-mask, filter, or air supplied type), all present a fluid intake and a fluid outlet. The fluid outlet is typically a conventional exhalation valve. The disposable cover of the present invention includes a thin flexible body having an opening for providing access to the fluid intake and presents a clearance around the fluid outlet. Further, the cover presents a releasable mechanism for attaching the body to the respirator. In preferred forms, the clearance of the body adjacent the fluid outlet is provided by a gathered, cuplike section giving a loose fit of the body adjacent the region of the exhalation valve outlet to allow unrestricted breathing.

For full-face mask respirators having a see-through pane overlying the worker's eyes, the body hereof incorporates a transparent panel as a part thereof. With the cover attached to the respirator, the panel overlies the pane of the respirator allowing the worker to see out while protecting the respirator and pane from particulate accumulation. The covers are preferably attached to the respirator dependent upon the exact structure of the respirator involved.

BRIEF DESCRIPTION OF THE DRAWINGS

FIGS. 1–4 illustrate a first embodiment of a cover of the present invention for use with a filter type half-mask respirator wherein:

FIG. 1 is a partially exploded, perspective view showing a half-mask cover and a filter type half-mask respirator, FIG. 2 is a front elevational view showing a half-mask cover installed on a half-mask respirator, with the filters shown in phantom, FIG. 3 is a side elevational view of a half-mask cover for a filter type respirator, FIG. 4 is a plan view of a halfmask cover at an intermediate stage of manufacture;

FIGS. 5–7 depict a second embodiment of a cover in accordance with the present invention for use with an air supplied half-mask respirator wherein:

FIG. 5 is an exploded perspective view similar to FIG. 1, showing a half-mask cover and an air supplied half-mask respirator, FIG. 6 is an elevational view of a half-mask cover secured to an air supplied half-mask respirator, FIG. 7 is a plan view of an air supplied half-mask cover at an intermediate stage of fabrication;

FIGS. 8–10 show a third embodiment of a cover of the present invention for use with a filter type full-mask respirator wherein:

FIG. 8 is a partially exploded, perspective view of a full-mask cover and a filter type full-mask respirator, FIG. 9 is an elevational view of a full-mask cover secured to a filter type full-mask respirator, with the filters shown in phantom, FIG. 10 is a plan view of the full-mask cover of FIGS. 8 and 9 at an intermediate manufacturing stage;

FIGS. 11–13 illustrate a fourth embodiment of a cover for protecting an air supplied, full-mask respirator wherein:

FIG. 11 is a partially exploded, perspective view illustrating a full-mask cover and an air supplied full-mask respirator, FIG. 12 is an elevational view depicting a full-mask cover secured to an air supplied full-mask, FIG. 13 is a plan view of the air supplied full-mask cover illustrated in FIGS. 11 and 12 during manufacture;

FIGS. 14–15 illustrate a fifth embodiment of a cover for protecting either an air supplied or filter type full-mask respirator wherein:

FIG. 14 is a plan view of the cover at an intermediate stage of manufacture, and FIG. 15 is an elevational view and particularly illustrates the perforated, removable discs of the cover.

DESCRIPTION OF THE PREFERRED EMBODIMENTS

Figure 1:
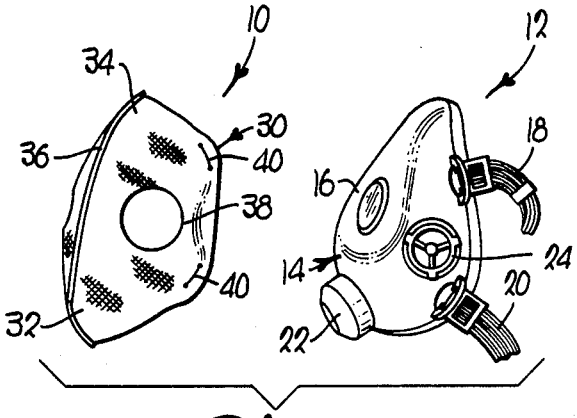

Referring now to the drawings, five embodiments of the present invention are illustrated with four different types of respirators. FIGS. 1–4 illustrate a cover 10 in accordance with the present invention for use with a filter type half-mask respirator 12. Generally speaking, the half-mask respirator 12 presents a bulbous shell 14 having an outermost surface 16. Respirator 12 is attached to the user by upper and lower straps 18, 20 secured at their distal ends to the outer periphery of the shell 14. The respirator 12 has at the lowermost end thereof an exhalation valve 22 which allows air to exit the mask when worn by the user. An intake 24 is usually disposed on each side of the respirator 12, each intake 24 having structure for permitting the attachment of a filter 26 (see FIG. 2). (It will be appreciated that respirators with a single intake are also available to which the cover 10 can be readily adapted.)

Cover 10 includes a thin, flexible body 30 composed of a non-porous flexible material. A spun bonded polyolefin (such as Tyvek made by E. I. du Pont de Nemours & Company of Delaware) has proven operable in this regard. The body 30 is configured to generally conform to the shape of the outer surface 16 of the respirator 12, and presents a lowermost cuplike section 32 and an uppermost cuplike section 34.

Figure 4:
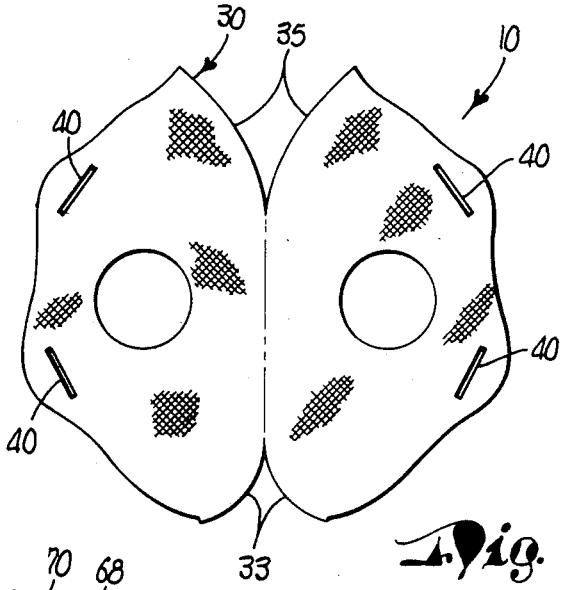

An elongated seam 36 runs between the lower and upper sections 32, 34 and symmetrically divides the body 30. FIG. 4 shows the configuration of the body 30 at an intermediate stage of manufacture, wherein the body 30 is laying flat. Sectors of the body 30 are removed at the upper and lowermost regions to present marginal edges 33, 35. The body 30 is heat treated (or alternatively sewn or bonded) joining the respective marginal edges 33, 35 to define the seam 36 and forming the cuplike lower and upper sections 32, 34. Thus, the sections 32, 34 are gathered portions of material to give the body 30 a configuration to generally conform to the shape of the respirator 12.

Figure 2:
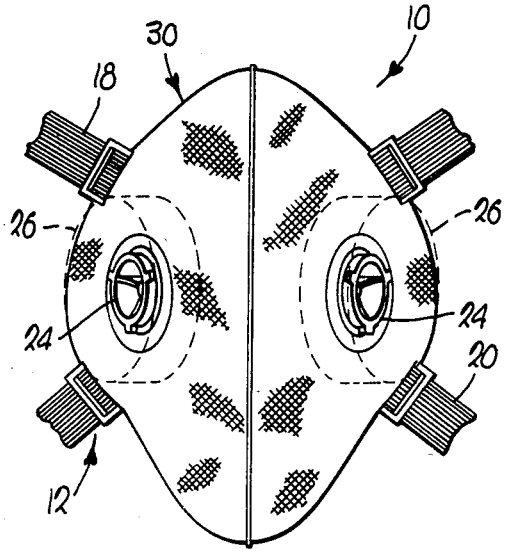
Figure 3:
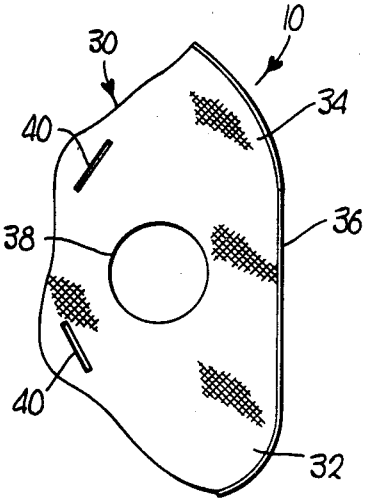

An aperture 38 is disposed on each side of the seam 36 through the body 30, such that with the body 30 overlaying the shell 14, the intakes 24 are received therethrough as shown in FIG. 2. Positioning the intakes 24 through the apertures 38 substantially retains the body 30 in place on the respirator 12. A cover for a respirator having a single intake would have one aperture similarly placed to receive the intake which would serve to retain or position the body on the respirator. In the embodiment of FIGS. 1–4, the body 30 further presents four holes or elongated slits 40 therethrough. A portion of the straps 18, 20 (e.g. the distal ends) are preferably routed through the slits 40 to aid in the securement of the body 30 to the shell 14. Alternatively, the upstanding headstrap connectors on the respirator may be routed through the slits 40 for securing the body 30.

Figure 5:
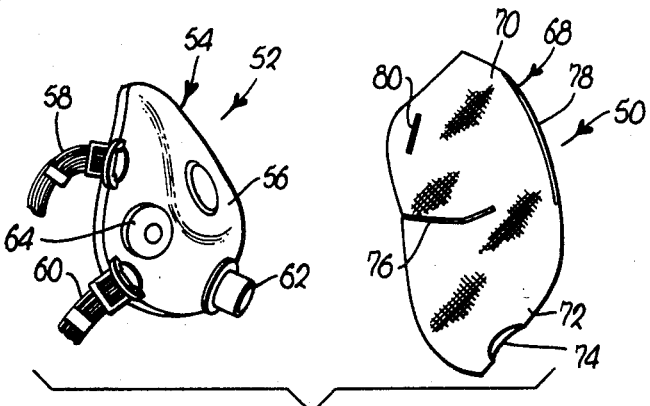

Turning now to FIGS. 5–7, a cover 50 adapted for protecting air supplied half-mask respirator 52 is illustrated. The respirator 52 presents a shell 54, an outer surface 56, and upper and lower straps 58, 60 connected to the periphery of the shell 54. Disposed in the lower region of the shell 54 is intake tube 62, which in use in connected to an elongated flexible conduit leading to an air supply. An exhalation valve 64 is also mounted on the shell 54.

The cover 50 is preferably composed of a non-porous material and presents a body 68 having an uppermost cuplike section 70 and a lower cuplike section 72. An aperture 74 extends through the body 68 such that with the cover 50 mounted to the respirator 52, the intake tube 62 extends through aperture 74 (see FIG. 6).

FIG. 7 shows the cover 50 at an intermediate stage of manufacture wherein a section has been removed from the top and another section removed from the side to define marginal edges 71, 73. The edges 71, 73 are joined and heat treated (or alternatively sewn or bonded) to present a side seam 76 and an elongated longitudinally oriented seam 78 (compare FIGS. 6 and 7). This gathering of the material construction not only allows the body 68 to conform generally to the shape of the outer surface 56 of the respirator 52, but also provides a cuplike section 72 providing clearance around the exhalation valve 64 with the cover 50 in place. The body 68 additionally has three holes or elongated slits 80 therethrough, such that with the cover 50 in place on the respirator 52, a portion of the respective straps 58, 60 (e.g. distal ends) can be routed through slits 80 to aid in securing the cover 50 to the respirator 52 (or alternatively, the connectors of the respirator can be used).

Turning now to FIGS. 8–10, a cover 100 is illustrated for protecting a full-face, filter type respirator 102. In more detail, the respirator 102 presents a shell 104 having a transparent, seethrough pane 106 and a nose and mouth circumscribing member 108. Shell 104 presents adjacent its outermost periphery several outwardly extending connectors 110 (see FIG. 8). As shown in FIG. 9, a harness 112 is used to affix the respirator 102 to the head of the user, with the harness 112 being attached at the distal ends of its straps to the connectors 110. The shell 104 (FIG. 8) presents exhalation valve 114 disposed beneath the pane 106. A pair of intakes 116 are presented on each side of the shell 104 and each includes a structure for securement thereto of a filter 118 (shown in phantom in FIG. 9). (In alternate forms, the respirator might present a single intake beneath the pane 106.)

The cover 100 broadly includes a body 120 composed of a thin, flexible, substantially nonporous material. The body includes a transparent panel 122 composed of flexible see-through material such as cellulose acetate. The remaining portion of the body 120 is preferably composed of a spun bonded polyolefin. A pair of apertures 124 are disposed through the body 120 such that with the cover 100 in place in the respirator 102, the intakes 116 are presented through the apertures 124. A number of holes or elongated slits 126 extend through the body 120 the periphery thereof; the cover 100 being fastened to the respirator 102 with the holes 126 receiving a portion of the harness connectors 110.

The body 120 presents a cuplike section 128 located below the panel 122. FIG. 10 illustrates the body 120 at an intermediate stage of manufacture, wherein the body 120 is substantially planar and has a portion thereof removed defining marginal edges 130. The cuplike section 128 is formed joining the edges 130 and heat treating or sewing or bonding the body along the joinder of the marginal edges 130. This gathering of material defines a seam 132 and forms the cuplike section 128 (FIG. 9).

FIGS. 11–13 illustrate a cover 150 in accordance with the present invention and an air supplied full-face respirator 152. The respirator 152 is similar to the respirator 102 shown in FIG. 8 and presents a shell 154 having a see-through pane 156 and a lowermost, mouth circumscribing portion 158. Operatively coupled to the shell 154 below the seethrough pane 156 is exhalation valve 160 and intake passageway 162. The shell 154 has outwardly extending tabs 164, preferably having buttons thereon (see FIG. 11). A harness 166 is included and has connections on the distal ends of its straps for attachment of the tabs 164.

The cover 150 broadly presents a body 170 composed of a thin, flexible, substantially nonporous material. The body 170 has a transparent panel 172 (for example, composed of a cellulose acetate), while the remaining portion of the body is preferably composed of a spun bonded polyolefin material. A cuplike section 174 is presented in the body 170 beneath the panel 172 and includes an aperture 176 extending therethrough (see FIG. 11). A plurality of holes or elongaged slits 178 are presented along the periphery of the body 170 and are operable for securement to the tabs 164 (or alternatively the distal ends of the harness straps may be threaded through the holes 178).

FIG. 13 depicts the cover 150 at an intermediate stage of manufacture wherein the body 170 is substantially lying flat. A portion of the body 170 is removed to present the aperture defining edge 180 and lower peripheral margins 182 (see FIG. 13). The body 170 is then gathered with the peripheral margins 182 joined and heat treated (or sewn or bonded) presenting a seam 184 and defining the cuplike section 174. As shown in FIG. 12, in operation a flexible conduit 186 is inserted in the intake passageway 162 and connects the respirator 152 with an external air source.

Figure 14:
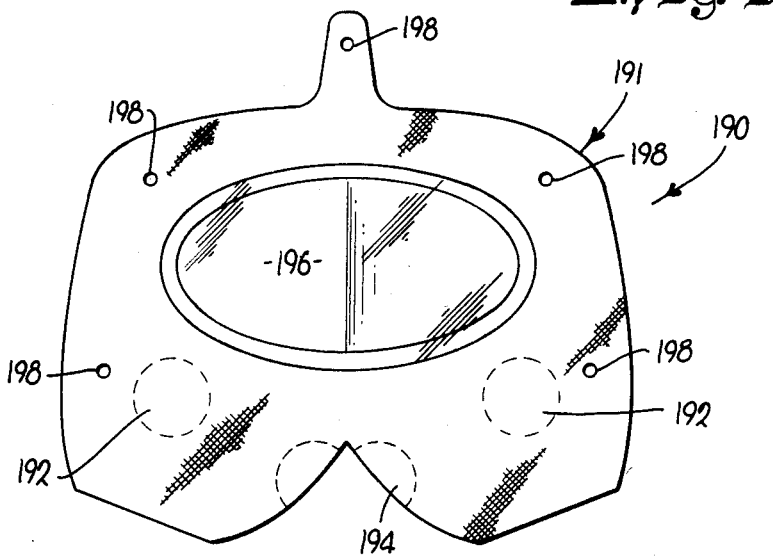
Figure 15:
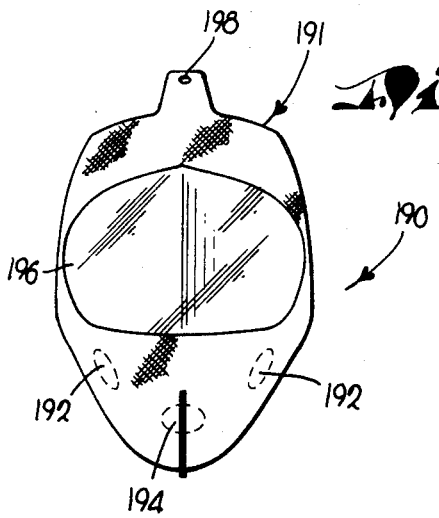

Turning to FIGS. 14–15 a cover 190 is illustrated which is adaptable to protect either a full face filter type respirator 102 (FIG. 8) or an air supplied full face respirator 152 (FIG. 11). To this end, the cover 190 has a body 191, a pair of side removable discs 192, and a central removable disc 194. Preferably, the discs 192, 194 are attached to the body 191 (such as by narrow tabs or perforations) such that the discs may be easily and sectively removed. The spacing between the tabs or perforations is designed to prevent significant penetration of airborne contaminants through the body 191. Additionally, the cover 190 includes a seethrough pane 196 and holes 198 (for attachment purposes).

The cover 190 can be fitted to a filtertype respirator 102 (FIG. 8) by simply removing the side discs 192 while leaving the central disc 194 in place. That is, with the discs 192 removed, side holes are defined and fitted over the intakes 116. Alternatively, the cover 190 can be adapted for use with the air-supplied respirator 152 (FIG. 11) by removing disc 194 and leaving discs 192 in place. In any event, the cover 190 is attached to the particular respirator in similar fashion as covers 100, 150.

USE

The covers 10, 50, 100, 150 and 190 of the present invention all generally operate in the same fashion in protecting their respective respirators. Generally speaking, the covers are secured in overlying relationship to the respirator and releasably attached thereto. With a cover in place on a respirator, the worker simply enters the particular industrial environment (e.g. paint booth) with the cover substantially protecting the respirator from particulate accumulation. The embodiments of the present invention include a cuplike section (32, 72, 128, 174) which provides a clearance around the exhalation valve when the cover is attached to the respirator. This allows the worker to freely exhale without breathing restriction, while protecting the exhalation valve from particulate deposit.

Each of the covers 10, 50, 100, 150 and 190 are designed to be easily attached and detached from the respective respirators. When a cover becomes heavily laden with particulate matter, the cover is torn off and thrown away and a new cover installed. In alternative forms, a plurality of covers might be serially disposed upon a respirator, with only the outermost cover torn off and thrown away at the expiration of its useful life. In any event, the covers of the present invention are particularly useful in protecting the different types of respirators from damage from industrial particulates, not only preventing undue wear to the respirator, but also saving substantial labor costs by the elimination of the frequent respirator cleaning heretofore required in many industrial environments.

We claim:

1. In the combination of a face respirator and a protector for the outer surface of said respirator, said respirator having a fluid intake and fluid outlet, said respirator having an outer surface with a perimeter adapted to complementally conform to the configuration of a human face, the improvement comprising:

said protector comprising a thin, flexible, essentially non-porous, initially flat sheet configured to generally conform to the shape of said surface in substantial overlying parallelism thereto, said sheet having a perimeter substantially complemental in dimension and configuration to said perimeter of the outer surface of said respirator, said sheet having structure defining an opening for providing said access to said intake and having means for clearing said outlet; and means on said sheet and securable to said respirator for releasably coupling said sheet to said respirator to enable simultaneous handling of said protector with said respirator.

2. A protector as set forth in claim 1, said clearing means comprising a cuplike section for providing a loose fit of the sheet relative to said surface in the region of said outlet.

3. A protector as set forth in claim 1, said section including a gathered portion of said sheet provided with a seam.

4. A protector as set forth in claim 1, said opening defining a structure comprising an aperture through said sheet.

5. A protector as set forth in claim 1, wherein said opening defining structure comprises a plurality of spaced-apart perforations through said sheet presenting a removable disc.

6. A protector as set forth in claim 1, said respirator having a plurality of straps secured thereto, said releasable means comprising a plurality of slits through said sheet for receiving said straps.

7. A protector as set forth in claim 1, said respirator having a plurality of connectors, said releasable means comprising a plurality of holes through said sheet for receiving respective connectors.

8. A protector as set forth in claim 1, said respirator having a see-through pane, said sheet including a transparent panel as a part thereof disposed in front of the pane when the sheet is attached to said respirator.

9. A protector as set forth in claim 1, said intake comprising two spaced-apart inhalation valves and means on each valve for attaching a filter thereto, said sheet presenting an opening for each intake respectively.

* * * * *